United States Patent [19]

Frech

[11] 4,138,043

[45] Feb. 6, 1979

[54] DIE CASTING MACHINE WITH SCREW PLUGS IN PASSAGES

[75] Inventor: Wolfgang Frech, Schorndorf-Weiler, Fed. Rep. of Germany

[73] Assignee: Firma Oskar Frech Werkzeugbau, Fed. Rep. of Germany

[21] Appl. No.: 756,980

[22] Filed: Jan. 5, 1977

[51] Int. Cl.[2] ..... B22D 17/02; B22D 39/00

[52] U.S. Cl. ..... 222/596; 164/318; 228/140

[58] Field of Search ..... 164/316, 318; 228/140; 222/596, 385; 138/89, 92; 220/289

[56] References Cited

U.S. PATENT DOCUMENTS

| | | | |
|---|---|---|---|
| 2,000,488 | 5/1935 | Korsno | 222/385 |
| 2,835,005 | 5/1958 | Green | 222/385 |
| 3,495,652 | 2/1970 | Perrella | 164/316 |
| 3,777,943 | 12/1973 | Spalding et al. | 164/318 |

FOREIGN PATENT DOCUMENTS

| | | | |
|---|---|---|---|
| 746212 | 6/1944 | Fed. Rep. of Germany | 222/596 |
| 349479 | 9/1972 | U.S.S.R. | 222/385 |

*Primary Examiner*—David A. Scherbel
*Attorney, Agent, or Firm*—Craig & Antonelli

[57] ABSTRACT

A gooseneck for a hot chamber die casting machine, which gooseneck includes a compression chamber having a pressure piston movably mounted therein with the compression chamber being in communication witha conical mouthpiece by way of transverse and vertical passages. The mouthpiece is arranged in a neck projecting from the gooseneck with the entire gooseneck being forged from a heat-resistant tool steel. The area of the casting container which includes the compression chamber and the vertical passage has in cross-section the form of two cylinders with parallel axes. A heating device may be provided for heating the projecting neck portion forming the mouthpiece of the gooseneck and a further heating construction may be provided for heating the injection nozzle to prevent the solidification of a melt therein. The vertical passage and transverse passage are cast as through-passages with one end of each of the passages being closed by way of a screw plug provided with a cutting edge which is directed toward the respective passage and which penetrates into the material of the gooseneck as the respective plugs are inserted into the passages. The plugs are heated prior to being inserted into the respective passages whereby, when the plugs are tightened, the material of the respective plugs and the material of the gooseneck are fused so that an effect similar to welding occurs.

22 Claims, 3 Drawing Figures

DIE CASTING MACHINE WITH SCREW PLUGS IN PASSAGES

The present invention relates to a casting arrangement and, more particularly, to a gooseneck for a hot chamber die casting machine, wherein the gooseneck includes a compression chamber having a pressure piston with the compression chamber communicating by way of transverse and vertical passages to a conical mouthpiece mounting an injection nozzle. The gooseneck is formed as a casting out of a heat-resistant tool steel with the cross-sectional area of the gooseneck including the compression chamber and vertical passage bore being in the form of two parallel axis cylinders.

In hot chamber die casting machines, the gooseneck is normally immersed in a molten metal contained in a vat inserted into a furnace. In the processing of magnesium, extremely high temperatures and high stresses, for example, temperatures up to 700° C. and pressures up to 500 atm., occur in an area of the compression chamber of the gooseneck. Consequently, goosenecks have traditionally been produced as a forged steel; however, a disadvantage of such construction resides in the fact that the goosenecks can only be produced at a relatively high cost.

It has been proposed to cast goosenecks of a heat-resistant tool steel. Such goosenecks have the advantage that they can be produced almost completely in final form in one process. Moreover, it has been shown that there are heat-resistant tool steels which are accustomed to the extreme stresses and can be so processed that no cavity formation or material embedment occurs, even during casting, which cavity formation or material embedment, at high temperatures and high pressures, could lead to distortion and/or deformation or even cracking of the gooseneck.

In proposed goosenecks, a mouthpiece with a conical cutout is provided into which is inserted a corresponding cone of an injection nozzle. However, in these proposed constructions, not only did the mouthpiece most often exhibit early signs of wear, such constructions were limited in that the mechanical stress on the passage from the injection nozzle to the gooseneck was very great through the cone and these stresses also occurred in the cone area.

A further problem of proposed goosenecks resides in the fact that a vertical passage, normally cast as a through-passage, which leads out from the bottom of the gooseneck of the compression chamber to the mouthpiece, are sealed or closed at the bottom thereof only by special plugs which, of necessity, were welded to achieve the required thickness in the casting vessel. However, in spite of careful processing, damages appeared at, and at engagement points with, the weld points of the special plug and the gooseneck, thereby subjecting these points to great stresses.

The aim underlying the present invention essentially resides in improving the proposed gooseneck. For this purpose, provision is made according to the present invention that the mouthpiece of the gooseneck is embodied as a neck projecting from the casting vessel, which neck is heated from the outside. By virtue of this construction, the mouthpiece and cone fitting therein are lengthened so that surface stresses are reduced.

According to one advantageous feature of the present invention, an additional heating of the longer mouthpiece neck can be effected, thereby substantially reducing the heat stresses at the neck, resulting in a gooseneck having substantially longer service life than presently proposed goosenecks.

According to another advantageous feature of the present invention, the vertical passage in the gooseneck is closed off or sealed by a plug which is threadably inserted at the bottom of the passage, which plug is provided with a cutting edge directed toward the passage so as to cut into the gooseneck material as the plug is inserted into the passage. Preferably, the cutting edge of the plug is configured as an annular cutting edge which is concentric to a triangular cutting on the plug axis of which the cutting angle is approximately 120°.

Preferably, in accordance with the present invention, the plug is heated prior to insertion into the vertical passage and is subsequently screwed in tightly. Upon cooling, the plug shrinks in the axial direction so that its cutting edge presses tightly into the material of the gooseneck which can be suitably flattened at the point of contact. By virtue of this arrangement, a welding of the plug to the gooseneck is unecessary; however, an excellent closure or sealing of the passage is nevertheless obtained.

According to a still further advantageous feature of the present invention, the gooseneck is manufactured out of a heat-resistant tool steel which contains as alloy elements 0.2% carbon, 10% chromium, 2.2% molybdenum, 6.8% tungsten, 10% cobalt, with the remaining composition being composed of iron. The manufacturing of a gooseneck of a heat-resistant tool steel having such composition results in the production of a vessel requiring relatively few post-treatment procedures.

Preferably, the transverse passage communicating the vertical passage with the compression chamber is also fashioned as a through-passage with a plug, of the nature of the plug arranged at the vertical passage, being provided at one end of the transverse passage.

Accordingly, it is an object of the present invention to provide a gooseneck arrangement which avoids the aforementioned shortcomings and drawbacks encountered in the prior art.

Another object of the present invention resides in providing an improved gooseneck arrangement which reduces the surface stresses and heat stresses thereon.

A still further object of the present invention resides in providing a gooseneck which minimizes the post-treatment of the vessel after manufacture.

A still further object of the present invention resides in providing a gooseneck which has an increased service life over the presently proposed goosenecks.

These and other objects, features and advantages of the present invention will become more apparent from the following description when taken in connection with the accompanying drawings which show, for the purposes of illustration only, one embodiment of a gooseneck for a hot chamber die casting machine in accordance with the present invention, and wherein.

Figure 1:
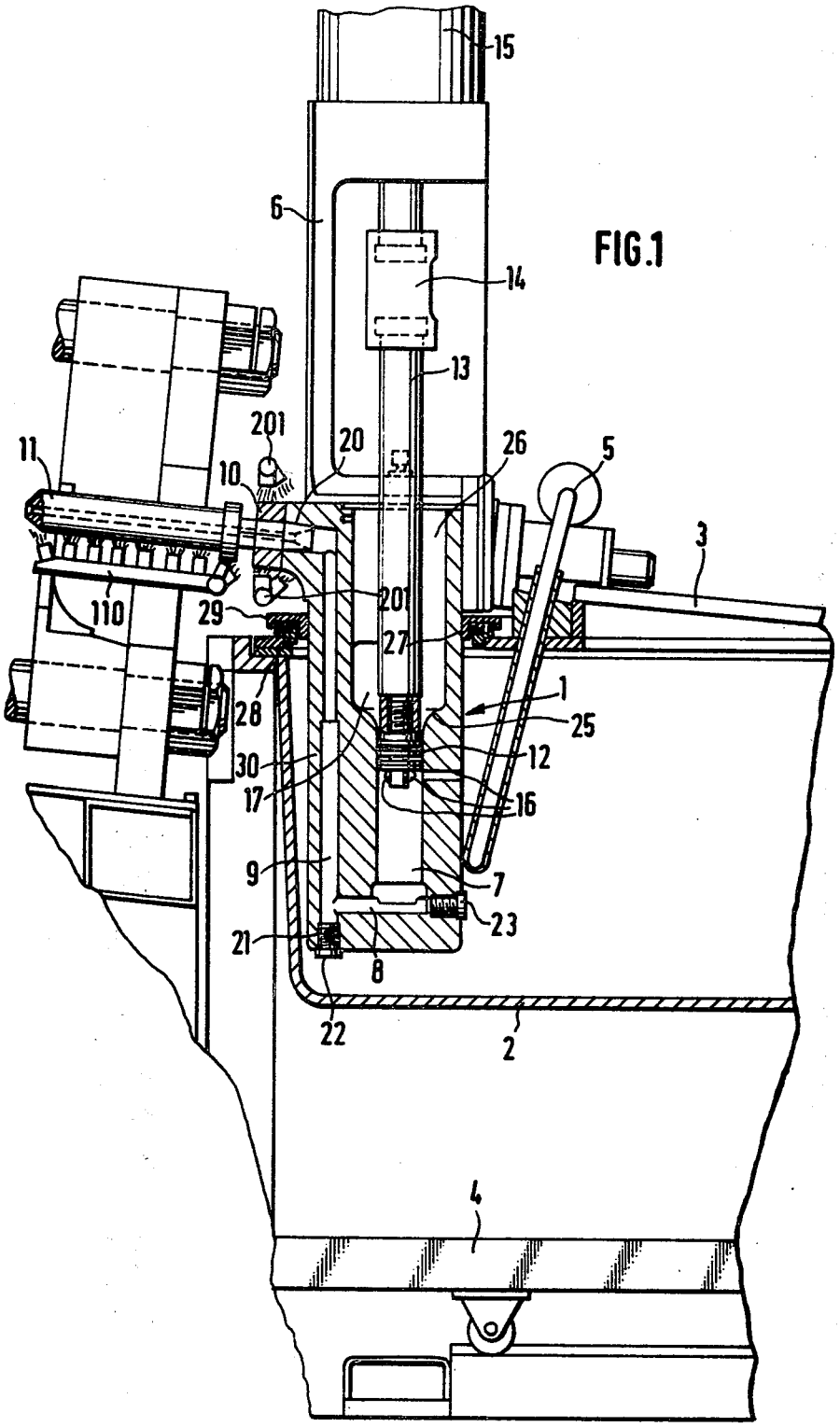
FIG. 1 is a partial cross-sectional view through a hot chamber die casting machine provided with a gooseneck in accordance with the present invention.

Referring now to the drawings, wherein like reference numerals are used throughout the various views to designate like parts and, more particularly, to FIG. 1, according to this figure, a hot chamber die casting machine has a gooseneck generally designated by the reference numeral 1 which is inserted into a vat 2 containing a molten metal, for example, magnesium, fed into the vat 2 through an opening closed off by a lid 3. The magnesium is normally in the form of pigs or bars of cast metal and the vat 2 is inserted into a furnace 4 so that the pigs therein can be melted with a thermometer 5 being immersed in the vat 2 to monitor the rising temperature in the area of the gooseneck 1.

Gooseneck 1, held by a girder 6, includes a compression chamber 7 connected to a vertical passage 9 by way of a transverse passage 8. The vertical passage 9 communicates with a mouthpiece 10 having attached thereto a tilted nozzle 11.

A piston 12 is arranged in the compression chamber 7 and is connected to a piston rod 13 and a coupling member 14 with a hydraulic cylinder 15. In FIG. 1, the piston 12 is illustrated in its top dead center position. A plurality of bores 16, distributed uniformly about the periphery of the compression chamber 7, are arranged at a position below the piston 12 when such piston is in the dead center position. The bores 16 communicate the compression chamber 7 with the vat 2.

The melt, which enters through the bores 16 into the compression chamber 7, passes or is forced through the passage 8 and vertical passage 9 to the nozzle 11 upon a displacement of the piston 12. Due to the inclined positioning of the nozzle 11, the melt which is not discharged through the nozzle 11 is drawn back into the area of the vertical passage 9 during an opposite or upward displacement of the piston 12, whereby the melt remains within a heated area to prevent solidification of the melt. Preferably, the gooseneck 1 is open at the top and includes an upper portion or area 26 which has a larger diameter than the internal diameter of the compression chamber 7. If desired, the area 26 may communicate with the vat 2 through openings or cutouts 17 so that the piston also has melt passing over the top side thereof during its working stroke. The cutouts or openings 17 are diametrically opposite each other and displaced by 90° with respect to the vertical passage 9.

According to the present invention, the gooseneck is manufactured as a forged element out of a heat-resistant tool steel which contains, as alloy elements, 0.2% carbon, 10% chromium, 2.2% molybdenum, 6.8% tungsten and 10% carbon, with the rest of the composition being constituted by iron. The tool steel of this composition is especially suitable for hot chamber die casting machines which process magnesium and its alloys since such steel contains no constituent which could be eroded by a magnesium melt. By virtue of the utilization of a tool steel of the noted composition, only relatively few post-treatment procedures must be undertaken. Specifically, only the surface 18 at which the gooseneck 1 is mounted on the girder 6 must be especially treated, and threaded bores 19 or the like may be provided at the surface 18 for receiving fasteners such as bolts or screws to mount the gooseneck 1 to the girder 6.

The mouthpiece 10, provided with a cone 20 to hold or mount the nozzle 11, is in the form of a neck projecting outwardly from the gooseneck 1 with burner nozzles 201 being arranged both above and below the mouthpiece 10. By virtue of this arrangement, the area of the gooseneck 1, which in proposed embodiments has the most stresses and is most inclined to damages, is held essentially stress-free, thereby increasing the service life of the gooseneck 1.

To prevent solidification of melt in the nozzle 11, at least one heating device 110 is provided which includes several nozzles supplied by gas or the like to produce a heating flame.

The passage 9 is cast as a vertical passage which communicates, at the bottom thereof, with the transverse passage 8 and compression chamber 7 of the gooseneck 1. A plug generally designated by the reference numeral 22 is arranged at the bottom of the vertical passage 9 with the plug being threadably inserted into a bore 21. As shown in FIG. 1, the diameter of the vertical passage 9 is stepped approximately in the middle thereof so that a bottom part of the vertical passage 9 has a larger diameter than the top part.

Figure 2:
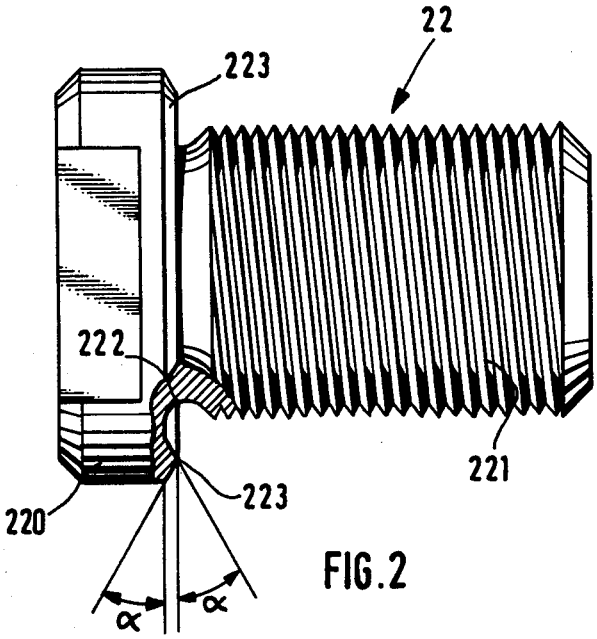
FIG. 2 is a perspective view, on an enlarged scale, of a plug or closure member for passages in the gooseneck in accordance with the present invention.

As shown most clearly in FIG. 2, the plug 22 has a cutout or groove 222 between a head 220 and a threaded part 221. The cutout or groove 222 is framed by a cutting edge 223 having a triangular or rectangular cross-section, taken along the longitudinal axis of the plug, and a sharp point. Preferably, the point angle of the cutting edge 223 is $(180° - 2\alpha)$ and, in the illustrated embodiment, is equal to 120°.

The plug 22 is manufactured as a forged element of the same material as the gooseneck 1 and has a resistance of 120 kp/mm$^2$. Prior to mounting, the plug 22 is heated to approximately 500° C. and is threadably inserted into the bore 21 and tightened as tightly as possible with a torque wrench. After cooling, the plug 22 is drawn toward its axis so that the cutting edge 223, which has already been impressed or cut into the material of the casting vessel during a tightening process, is further drawn into the casting vessel material.

Sectional X-rays or cross-sectional cuttings taken along the cutting point 223 indicate that the material of the plug 22 and gooseneck 1 are fused or turn into one another so that an effect similar to welding occurs without the necessity of the bothersome welding procedure which has often lead, in continuous service of a gooseneck, to the formation of cracks and subsequent leakage.

The communication of the passage 9 to the compression chamber 7 is effected through transverse passage 8 which extends from the vertical passage 9 across the width of the gooseneck 1. The end of the transverse passage 8 opposite the vertical passage 9 is sealed by a plug 23 which is formed and inserted into the passage 8 in the same manner as the plug 22.

In the manufacturing of the gooseneck 1, the most significant operation relates to the provision of a running surface for the piston 12. In accordance with the present invention, it is possible to precisely manufacture the gooseneck by casting a bore for accommodating the piston 12 and piston rod 13 which is then hollowed out with the inner walls of the compression chamber subsequently being honed to provide a perfect running surface for the piston 12.

The bore accommodating the piston rod 13 and piston 12 includes an upper portion 26, lower portion 24 and intermediate portion 25 defining the upper limits of the compression chamber 7. To minimize the necessary machining or honing of the gooseneck to provide the perfect running surface for the piston 12, only the area of engagement of the piston 12 with the inner walls of the compression chamber 7 is treated; namely, the area defined between the intermediate portion 25 and the lower portion 24 which has a larger diameter than the remaining portion of the compression chamber 7. Since the upper portion 26 merely surrounds the piston rod 13 with a clearance and since the cutouts or openings are arranged at the upper portion 26, no post-treating or machining of the upper portion 26 or openings 17 is necessary.

Preferably, the entire gooseneck 1 has a more-or-less cylindrical cross-section with only the upper edge, at which it is attached to the girder 6, having nearly a rectangular cross-sectional configuration. A ring-shaped member 28 is arranged at a somewhat cylindrical portion 27 of the gooseneck with the member 28 being adapted to receive a cover 29. The cutouts or openings 17 are arranged in the upper portion 26 at a position below the ring-shaped member 28.

An approximately semi-cylindrical portion 30 follows the cylindrical part 27 with the larger diameter portion of the vertical passage 9 being arranged in the semi-cylindrical portion 30. By virtue of this construction, an essentially uniform wall strength is obtained so that the danger of distortion or even cracking as a result of heat stresses is avoided even with the relatively rapid heating of the gooseneck 1.

Figure 3:
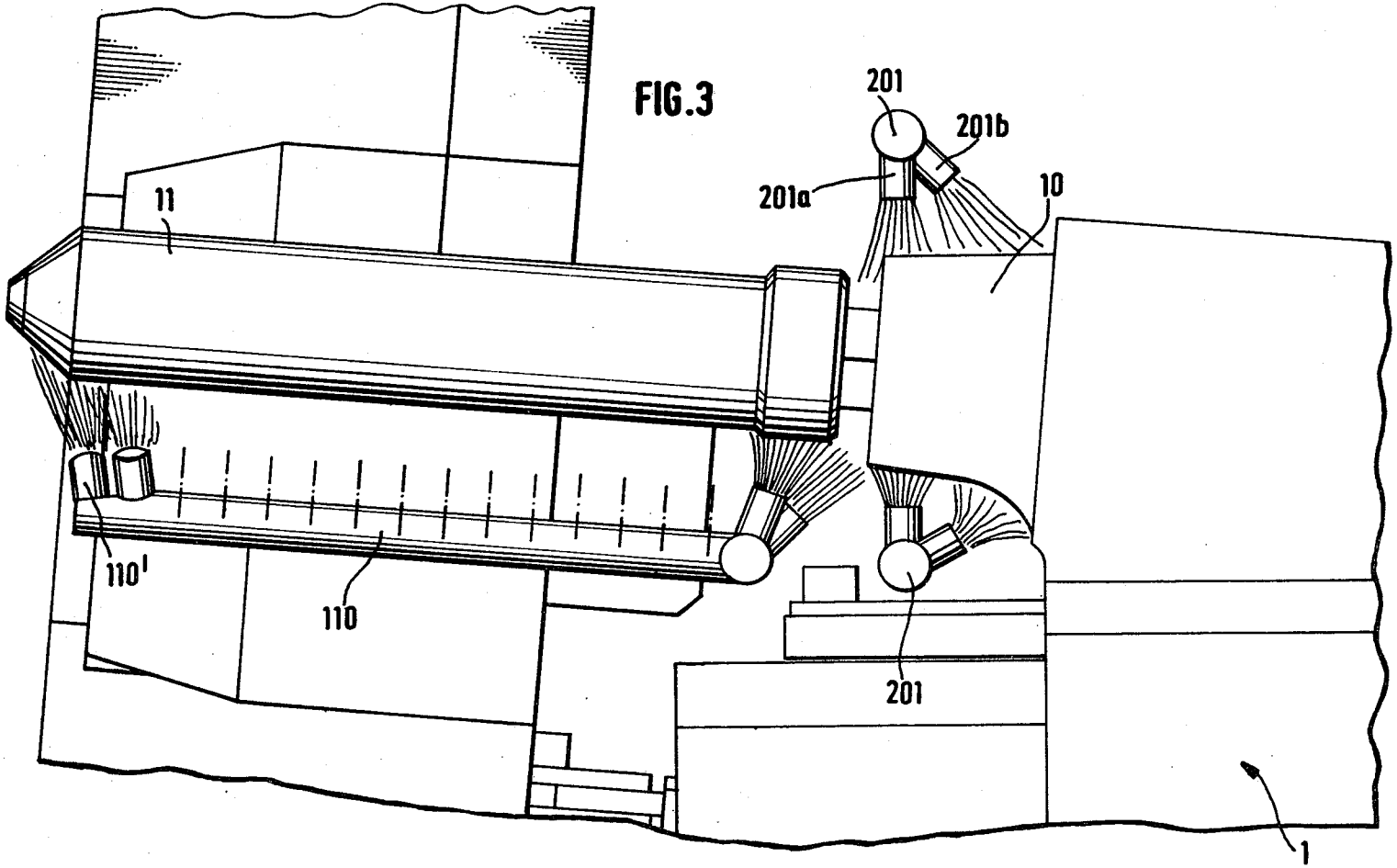
FIG. 3 is a detailed view, on an enlarged scale, of the mouthpiece of the gooseneck with an injection nozzle and heating arrangement in accordance with the present invention.

As shown in FIG. 3, the heating nozzles 201 each include at least two nozzles 201*a*, 201*b* which may be aligned or placed at an angle to each other. The heating device 110 for heating nozzle 11 includes a plurality of individual burner nozzles 110' which may be in series in pairs one after the other and offset at 15° to the left and right so that adjacent pair of nozzles 110' subtend therebetween an angle of 30°. In FIG. 3, fourteen pairs of nozzles 110 are provided one after the one, of which some of the nozzles are only schematically illustrated by their longitudinal center axis.

By virtue of the provision of the heating nozzles 201 at the mouthpiece 10, the heat stresses at the mouthpiece neck can be considerably reduced. Also, the provision of the individual burner nozzles 110 ensure a uniform heating of the nozzle 11 and prevent solidification of the melt therein, thereby avoiding a clogging of the nozzle 11.

While I have shown and described only one embodiment in accordance with the present invention, it is understood that the same is not limited thereto, but is susceptible of numerous changes and modifications as known to a person skilled in the art, and I therefore do not wish to be limited to the details shown and described herein, but intend to cover all such changes and modifications as are encompassed by the scope of the appended claims.

I claim:

1. A gooseneck for a hot chamber die casting machine, the gooseneck comprising:

a compression chamber means, a pressure piston means displaceably mounted in said compression chamber means, an injection nozzle means for injecting a melt from the gooseneck, means for communicating the compression chamber means with said injection nozzle means including a first passage cast as a through-passage, said passage and said compression chamber means having a cross-sectional form of two cylinders having parallel axes, a plug means threadably inserted into said first passage for closing an end of said passage opposite said nozzle means, a cutting means arranged on said plug means so as to face said first passage when said plug means is inserted into said first passage, said cutting means including a cutting edge which penetrates into the gooseneck upon threadably inserting the same into said first passage, said cutting edge is annular and concentric to a longitudinal axis of said plug means and has a triangular cross-sectional configuration as taken along the longitudinal axis of said plug means, and means for mounting said nozzle means at the gooseneck including a projecting neck portion extending radially outwardly from the gooseneck.

2. A gooseneck according to claim 1, wherein the gooseneck is forged of a heat-resistant tool steel.

3. A gooseneck according to claim 2, wherein said means for mounting said nozzle means at the gooseneck includes a conical mouthpiece arranged in said neck portion.

4. A gooseneck according to claim 3, wherein means are provided for heating the outside of at least said neck portion of the gooseneck.

5. A gooseneck according to claim 4, wherein said compression chamber means includes inner walls, and wherein at least a portion of said inner walls serve as a running surface for said pressure piston means.

6. A gooseneck according to claim 5, wherein said compression chamber means includes a first portion having a first diameter and a second portion having a second diameter larger than the diameter of the first portion, and wherein the running surface for the pressure piston means is arranged in said first portion of said compression chamber means.

7. A gooseneck according to claim 6, wherein said means for communicating the compression chamber means with the nozzle means further includes a second passage extending transverse to and communicating with said first passage and said second portion of said compression chamber means.

8. A gooseneck according to claim 2, wherein said cutting edge includes a cutting point having an angle of 120°.

9. A gooseneck according to claim 8, wherein a cutout is provided at said plug means framed by said cutting edge.

10. A gooseneck according to claim 9, wherein said plug means consists essentially of an iron alloy composed of approximately 0.2% carbon, 10% chromium, 2.2% molybdenum, 6.8% tungsten and 10% cobalt, with the balance being substantially iron.

11. A gooseneck according to claim 10, wherein said plug means is threadably inserted into said first passage in a heated state.

12. A gooseneck according to claim 11, wherein said plug means is heated to 500° C. prior to inserting the same into the first passage means and subsequently threadably inserted into the passage means as tightly as possible.

13. A gooseneck according to claim 1, wherein said cutting edge includes a cutting point having an angle of 120°.

14. A gooseneck according to claim 13, wherein a cutout is provided at said plug means framed by said cutting edge.

15. A gooseneck according to claim 14, wherein said plug means consists essentially of an iron alloy composed of approximately 0.2% carbon, 10% chromium, 2.2% molybdenum, 6.8% tungsten and 10% cobalt, with the balance being substantially iron.

16. A gooseneck according to claim 1, wherein said means for communicating the compression chamber means with the nozzle means further includes a second passage extending transverse to said first passage and communicating said first passage with said compression chamber means, said second passage being cast as a through-passage, and wherein a plug means is threadably inserted into said second passage for closing an end of said second passage opposite said first passage.

17. A gooseneck according to claim 1, wherein said first passage is cast as a through-passage, and wherein a second plug means is threadably inserted into said first passage for closing an end of said passage opposite said nozzle means.

18. A gooseneck according to claim 17, wherein said second plug means includes a cutting means arranged thereon so as to face said second passage when said second plug means is inserted into said second passage.

19. A gooseneck according to claim 18, wherein said cutting means of said second plug means is a cutting edge which penetrates into the gooseneck upon threadably inserting said second plug means into said first passage.

20. A gooseneck according to claim 19, wherein said second plug means consists essentially of an iron alloy composed of approximately 0.2% carbon, 10% chromium, 2.2% molybdenum, 6.8% tungsten and 10% cobalt, with the balance being substantially iron.

21. A gooseneck according to claim 15, wherein the gooseneck consists essentially of an iron alloy composed of approximately 0.2% carbon, 10% chromium, 2.2% molybdenum, 6.8% tungsten and 10% cobalt, with the balance being substantially iron.

22. A gooseneck according to claim 1, wherein the gooseneck consists essentially of an iron alloy composed of approximately of 0.2% carbon, 10% chromium, 2.2% molybdenum, 6.8% tungsten and 10% cobalt, with the balance being substantially iron.

* * * * *